United States Patent [19]

Neumann

[11] 4,199,189

[45] Apr. 22, 1980

[54] ASSEMBLY OF PREFABRICATED PARTS FOR MANUFACTURE OF BENCHES, TABLES AND THE LIKE

[76] Inventor: Herwig Neumann, Herrenberger Str. 39, 7031 Hildrizhausen, Fed. Rep. of Germany

[21] Appl. No.: 898,668

[22] Filed: Apr. 21, 1978

[30] Foreign Application Priority Data

Apr. 21, 1977 [DE] Fed. Rep. of Germany ..... 2717645

[51] Int. Cl.[2] ..... A47C 1/12; A47C 7/00; A47C 7/02

[52] U.S. Cl. ..... 297/445; 297/440; 297/452

[58] Field of Search ..... 297/440, 443, 445, 446, 297/452, 454

[56] References Cited

U.S. PATENT DOCUMENTS

| | | | |
|---|---|---|---|
| 2,798,538 | 9/1957 | Dreifke | 297/440 X |
| 2,994,558 | 8/1961 | Draxler | 297/446 |

FOREIGN PATENT DOCUMENTS

| | | | |
|---|---|---|---|
| 1438493 | 6/1976 | United Kingdom | 297/440 |

*Primary Examiner*—James C. Mitchell
*Attorney, Agent, or Firm*—Shlesinger, Arkwright, Garvey & Dinsmore

[57] ABSTRACT

Outdoor furniture and the like comprising a plurality of seat elements having longitudinal recesses formed in the bottom thereof and transverse openings extending therethrough, the openings having an enlarged counterbore at the ends thereof in the sides of the seat elements, a plurality of back elements, each of the back elements having a longitudinal recess formed in the rear thereof and transverse openings extending therethrough, the transverse openings having enlarged counterbores at the ends thereof, a plurality of angled support members having one portion lying in the recess in the seat element and another portion lying in the recess in the corresponding back element, a spacer element having an axial bore therein positioned between adjacent seat elements and between adjacent back elements and lying in the counterbores in the respective elements, flexible tie rods extending through the openings in adjacent elements and through the spacer elements and the support member, and means for securing the tie rods under tension for securely connecting the elements and the support members.

5 Claims, 4 Drawing Figures

ASSEMBLY OF PREFABRICATED PARTS FOR MANUFACTURE OF BENCHES, TABLES AND THE LIKE

The invention relates to the assembly of prefabricated parts for manufacture of benches, tables and the like which are objects for garden and park structures. Opportunities to sit down and the presence of tables in seating areas are important in private gardens, public parks, and sports and recreation areas. Such objects must be weather resistant and corrosion resistant and also be of suitable configuration. Known park benches are of heavy construction, for example having wooden planks on cast iron frames. The same is true for tables in rest and recreation areas.

The object of the invention is an assembly of prefabricated parts for production of benches, tables and other devices which serve as garden and park furniture, wherein such objects can be constructed in various forms and lengths of the same simple basic elements, and which can be made in units which are easily transportable, durable and inherently stable.

The object of the invention is characterized in that a series of seat elements which are of essentially the same small dimensions and are of wood, plastic or some other weather resistant material, and which each contain a groove and a support element inserted therein, are braced with the aid of tie rods, which extend through aligned transverse bores in the seat elements and in the support elements, are in series, as desired in straight or curved progression, and wherein the support elements have angular extensions with transverse bores, which are braced together as necessary with the aid of tie rods and with interposition of spacers, in the curve progression resulting from the series of seat elements.

The seat elements can be combined into a curved or angular bench or table surface, whereby the support elements which are inserted in the grooves on the undersides are to serve as holder for a backrest, or in the case of a table, as connection parts which extend downward to a foundation of some sort. The mounting of the support elements in grooves protects them from the effects of weather and the sides of a bench or, e.g. a bar table, are free of metal parts, and a continuity with other similar or like elements is possible. Another advantage is that predefined curves can be followed by the garden set or other structural assemblies and also a construction which braces and supports itself can be obtained, of which the strength results from the opposing bracing of the system in two planes at an angle to each other. The assembly of prefabricated parts uses preferably small dimension wooden elements, of which the dimensions can be standardized and thereby can make possible a support construction. This meets the requirements not only for simple on-site construction but also for industrial assembly line production.

An important feature of the construction exists in that a series of transversely arranged structural elements is braced in longitudinal direction and in two different planes. This principle is obtained in a bench wherein the seat elements as well as the backrest elements are braced together, but with use of the combined support elements. With a table, this principal is important in that the support elements which are used for the backrest serve as legs and are also in this case braced by use of the desired arrangement of spacers opposite each other, so that a remarkable durability is obtained. Because the seat construction used in the table is already solid in itself, little need be changed for the strength of the base structure, for it serves only for the static support and need withstand no flexing force.

The assembly of prefabricated parts can also be used advantageously for manufacture of other objects, e.g. for bars at standing level, for camouflage walls or room partition elements of wood or pergola type, whereby one braced element can be vertical and the second plane can run horizontal or at an angle to the first, so that a roof-like element or else a border is formed. The support elements correspond then to the transverse cross section through such an apparatus.

With the bench, the extensions of the support elements can form an angle arm which is curved to form the bench backrest, while the spacers consist essentially of small backrest elements each provided with a vertical longitudinal groove to hold the angle arm. The seat elements are preferably narrow sections of circular rings, each of the same length and having the same transverse bores therein, which are each at the same distance from the inner and outer ends. With this spacing, it is possible to join the sectored seat elements, which have opposite curve trend, if e.g. it is desired that the curve taper into a straight line.

The backrest elements are of different widths corresponding to the curve trend of the bench and to the distances which are thereby varied between the upwardly directed angle arms. But this is not absolutely necessary, as it is also possible, with the same or nearly the same width backrest elements, that differences can be bridged by additional spacers.

For fitting to desired curvatures, the tie rods are preferably flexible iron rods and are provided with threading at least at one end. Spacer sheathings can be arranged between adjacent seating elements, surrounding the tie rods. They bestow covered appearance at the joints of the construction. The spacers carry the stress forces between the individual seat and backrest elements as much as possible near the tie rods. The spacers are preferably of equal length. In order to expand possibilities of configurations, different spacer lengths can be provided, so that the curves are dependent not only upon the sector configuration of the seat elements. This freedom of configuration is further extended if a seat element of the same width is inserted behind each or every other section element.

For good transmission of stress in the bracing, the transverse bores can have cutouts into which the spacer, for example configured as a sheathing, can be partially inserted. The cutouts also have the purpose of making it possible to cover the head of each tie rod and also the tightening screws at the front.

The support elements are preferably upright angles of flat material, which receive the stresses while the bench is in use and also allow for the provision of the necessary grooves even with small dimension narrow wooden planks, and then still leave room for the cutouts of the transverse bores.

With a round or oval table, the support elements can have a horizontal arm mounted in a groove on the underside of the seat element and a connection arm which projects downward, whereby adjacent connection arms are braced by insertion of spacers with the aid of annular tie rods. The connection arms which project downward can be angled as in a bench. In this case, the table has a middle opening. If, however, the connection arms form an acute angle with the other arm of the support element, then a closed table plate is formed and the footing also attains good stability.

The apparatus according to the invention are mostly attached or mounted on permanent foundation structures. In the case of the seating bench, individual stationary concrete foundations or a concrete box can be used. Customary means serve for mounting on such foundations, for example connection bars or plates which are mounted either directly on the support elements or are threaded together on the tie rod and then are braced with it.

A bench is described in the following as an example of the invention relative to the drawing.

FIGS. 1*a* and 1*b* show a diagram of a side view of a bench with a concrete box as foundation.

Figure 1A:
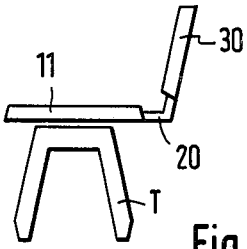
Figure 1B:
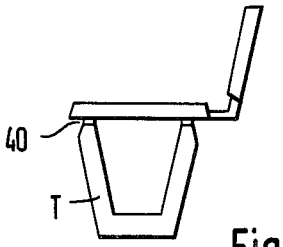
Figure 2:
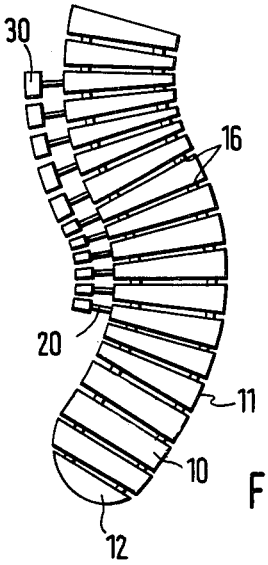
FIG. 2 shows a frontal view of a bench with curved trend configuration.

A bench according to the invention is preferably mounted detachably on a stationary foundation construction, which is in FIGS. 1*a* and 1*b* a box-like concrete member T, but can be replaced by any desired other suitable foundation configuration as shown in FIG. 2. The bench consists of small dimension seat elements of wood, plastic, or any other weather-resistant material, e.g. of asbestos concrete (Eternit) or the like. FIG. 2 shows rectangular seat elements 10, trapezoidal seat elements have transverse bores 14, which are preferably placed equidistant from the front and rear edges of each seat element. Transverse bores 14 open in cutouts 15 for fitting of spacer sheathings 16, which leave a slit 17. Furthermore, the seat elements have grooves 18 on their undersides which preferably pass all the way through.

A support element 20 is held in groove 18, and is provided with transverse bores 22. Support elements 20 consist of flat steel, which is inserted upright into groove 18. Tie rods 28 are threaded through transverse bores 14 and 22 as well as through the spacer sheating 16, and are of flexible steel. The tie rods have threading at the ends, whereby adjusting nuts are screwed with washers into cutouts 15 of the last seat element, accessible and workable from the outside.

With a bench with backrest, the support elements have angle arms 24 corresponding to the curve of the backrest, in which are provided two transverse bores 25. The angle arms 24 support backrest elements 30, which are of small individual units of wood or the like. As with the seat elements, transverse bores 33 and cutouts 35 are also provided here, whereby spacer sheatings 32 are inserted in the latter, forming slits 36.

The rear of backrest element 30 includes a groove 29 which need not necessarily extend to the top of the backrest element and which receives the angle arm 24. Tie rods 28 are threaded through transverse bores 25 and 34 and the backrest is braced. The braced bench has sufficient inherent rigidity to be transported and also used independent of a foundation construction.

FIG. 1*b* shows the mounting of the bench on the foundation construction T with the aid of two strips 40, which are mounted on the underside of seat elements 10–12 at spacing corresponding to the spacing of the box arms. The strips can be of wood or metal and have openings through which screws can be inserted from above for attachment to the base in the slits 17 between two seat elements.

Figure 3:
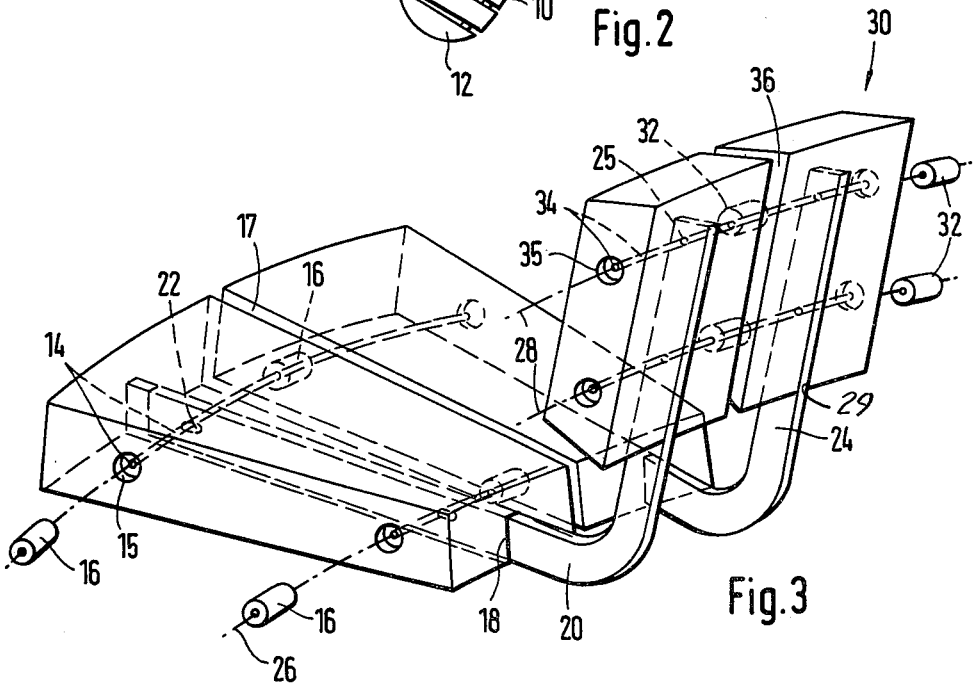
FIG. 3 shows a frontal view of two adjacent elements of a bench.

For production of a table, a same construction as in FIG. 3 can be used, whereby support elements 20 are tuned 180°, so that the angle arms 24 serve as table legs and the backrest element 30 as spacers, and need not necessarily have the height shown. Also other spacers can be used, e.g. tubes, for the bracing of the support arm.

In a simplified embodiment which is not shown, only seat elements are used, to construct a bench without backrest. The seat elements have at least two transverse bores and are braced as above with the aid of tie rods with insertion of spacers. Since the support elements, which serve otherwise for the bench backrest or the table legs, are deleted, the seat elements also need no grooves. Such constructions which extend in one plane only can be used as benches or as room dividers.

What is claimed is:

1. In the construction of benches and the like outdoor furniture, a plurality of seat elements each having a longitudinal recess formed in the bottom thereof and a pair of transverse openings extending therethrough, each of said openings having an enlarged counterbore at the ends thereof in lateral sides of said seat elements, a plurality of back elements equal in number to said seat elements, each of said back elements having a longitudinal recess formed in the rear thereof and a pair of transverse openings extending therethrough, each of said openings having an enlarged counterbore at the ends thereof in lateral sides of said back elements, a plurality of angled support members, each of said support members having one portion lying in said recess in one of said seat elements and another portion lying in said recess in one of said back elements, said openings and said counterbores in said elements being substantially aligned with adjacent openings in adjacent elements, a spacer element having an axial bore therein positioned between adjacent seat elements and between adjacent back elements and lying in said counterbores in said elements, flexible tie rods extending through the openings in adjacent elements, through said spacer elements and through said support member, and means for securing said tie rods under tension for securely connecting said elements and said support members.

2. A construction as in claim 1 and wherein:

said seat elements comprise narrow sectors of circular rings, each element having substantially the same length.

3. A construction as in claim 2 and wherein:

said back elements are of differing widths corresponding to the curve formed by said seat elements.

4. A construction as in claim 1 and wherein:

said transverse openings in said seat elements are spaced equidistantly from the ends of said seat elements.

5. A construction as in claim 1 and including:

a pair of spaced mounting strips secured to the bottoms of said seat elements, a foundation member for supporting said elements secured to said mounting strips.

* * * * *